US008646846B2

(12) United States Patent
Wentworth et al.

(10) Patent No.: US 8,646,846 B2
(45) Date of Patent: Feb. 11, 2014

(54) METHOD AND APPARATUS FOR CREATING A PLANAR CAVERN

(76) Inventors: Steven W. Wentworth, Fountain Hills, AZ (US); Samuel T. Ariaratnam, Scottsdale, AZ (US); Robert F. Crane, Oconomowoc, WI (US)

( * ) Notice: Subject to any disclaimer, the term of this patent is extended or adjusted under 35 U.S.C. 154(b) by 682 days.

(21) Appl. No.: 12/904,707

(22) Filed: Oct. 14, 2010

(65) Prior Publication Data

US 2012/0043800 A1 Feb. 23, 2012

Related U.S. Application Data

(60) Provisional application No. 61/401,990, filed on Aug. 23, 2010.

(51) Int. Cl.
*E21B 43/28* (2006.01)

(52) U.S. Cl.
USPC ..... 299/5; 299/35

(58) Field of Classification Search
USPC ..... 299/3, 4, 5, 6, 35; 175/53
See application file for complete search history.

(56) References Cited

U.S. PATENT DOCUMENTS

| | | | | |
|---|---|---|---|---|
| 733,073 | A | 7/1903 | Neukirch | |
| 753,092 | A | 2/1904 | Neukirch | |
| 1,998,877 | A | 2/1934 | Lawson | |
| 2,049,171 | A | 7/1935 | Osgood | |
| 2,351,175 | A | 7/1939 | Wilhelm | |
| 2,796,129 | A | 6/1957 | Brandon | |
| 3,620,573 | A | 11/1971 | De Villiers Oxford | |
| 3,881,775 | A | 5/1975 | McPherson et al. | |
| 4,220,203 | A * | 9/1980 | Steeman | 166/271 |
| 4,232,904 | A | 11/1980 | Hurd | |
| 4,290,650 | A * | 9/1981 | Thompson | 299/4 |
| 4,406,499 | A * | 9/1983 | Yildirim | 299/17 |
| 4,442,896 | A | 4/1984 | Reale et al. | |
| 4,832,411 | A | 5/1989 | Johnston et al. | |
| 5,033,795 | A | 7/1991 | Farrar et al. | |

(Continued)

FOREIGN PATENT DOCUMENTS

WO 2010074980 A1 7/2010

OTHER PUBLICATIONS

International Search Report and Written Opinion for International Patent Application No. PCT/US11/47280, mailed Jan. 26, 2012, 9 pages.

(Continued)

*Primary Examiner* — David Bagnell
*Assistant Examiner* — Michael Goodwin
(74) *Attorney, Agent, or Firm* — Sheridan Ross P.C.

(57) ABSTRACT

Methods and apparatuses for producing a planar cavern are provided. The planar cavern is formed by first creating a continuous bore that extends through a subsurface resource deposit. The continuous bore can be formed by connecting first and second bores at a point within the subsurface resource deposit. After the continuous bore has been formed, a sawing assembly is placed within the continuous bore. The sawing assembly is then moved, in a continuous or in a reciprocating fashion, within the continuous bore. As the sawing assembly is moved, it is maintained under tension, to create a planar cavern. By thus exposing a large area of the resource deposit, a relatively large amount of the resource deposit can be dissolved in a solvent introduced to the planar cavern per unit time. Saturated solution can then be pumped from the planar cavern, and the resource recovered from the saturated solution by evaporation.

18 Claims, 10 Drawing Sheets

(56) References Cited

U.S. PATENT DOCUMENTS

| | | | | |
|---|---|---|---|---|
| 5,186,266 | A | 2/1993 | Heller | |
| 5,213,169 | A | 5/1993 | Heller | |
| 5,216,999 | A * | 6/1993 | Han | 125/21 |
| 5,472,262 | A | 12/1995 | Buyens et al. | |
| 5,542,782 | A | 8/1996 | Carter, Jr. et al. | |
| 5,651,639 | A | 7/1997 | Wentworth et al. | |
| 5,685,380 | A | 11/1997 | Purcell et al. | |
| 5,879,110 | A | 3/1999 | Carter, Jr. | |
| 5,890,840 | A | 4/1999 | Carter, Jr. | |
| 5,899,272 | A | 5/1999 | Loree | |
| 5,905,184 | A | 5/1999 | Carter, Jr. | |
| 5,957,624 | A | 9/1999 | Carter, Jr. et al. | |
| 6,148,935 | A | 11/2000 | Wentworth et al. | |
| 6,260,634 | B1 | 7/2001 | Wentworth et al. | |
| 6,261,027 | B1 | 7/2001 | Wentworth et al. | |
| 6,263,983 | B1 | 7/2001 | Wentworth et al. | |
| 6,269,889 | B1 | 8/2001 | Wentworth | |
| 6,280,000 | B1 | 8/2001 | Zupanick | |
| 6,280,521 | B1 | 8/2001 | Carter, Jr. | |
| 6,390,087 | B1 | 5/2002 | Wentworth et al. | |
| 6,419,013 | B1 | 7/2002 | Milne et al. | |
| 6,450,269 | B1 | 9/2002 | Wentworth et al. | |
| 6,569,235 | B2 | 5/2003 | Carter, Jr. | |
| 6,578,631 | B2 | 6/2003 | Milne et al. | |
| 6,755,593 | B2 | 6/2004 | Wentworth et al. | |
| 6,761,507 | B2 | 7/2004 | Wentworth et al. | |
| 6,860,936 | B2 | 3/2005 | Carter, Jr. | |
| 6,910,829 | B2 | 6/2005 | Nickelson et al. | |
| 7,066,283 | B2 | 6/2006 | Livingstone | |
| 7,086,808 | B2 | 8/2006 | Wentworth et al. | |
| 7,264,048 | B2 | 9/2007 | Zupanick et al. | |
| 7,290,625 | B2 | 11/2007 | Amaudric Du Chaffaut et al. | |
| 7,290,626 | B2 | 11/2007 | Terlet et al. | |
| 7,343,983 | B2 | 3/2008 | Livingstone | |
| 7,647,967 | B2 | 1/2010 | Coleman, II et al. | |
| 7,686,400 | B2 | 3/2010 | Fredrick et al. | |
| 8,387,688 | B2 * | 3/2013 | Carter, Jr. | 166/245 |
| 2003/0044238 | A1 | 3/2003 | Wentworth et al. | |
| 2003/0084764 | A1 | 5/2003 | Wentworth | |
| 2003/0173085 | A1 | 9/2003 | Vinegar et al. | |
| 2006/0039842 | A1 * | 2/2006 | Day et al. | 423/206.1 |
| 2007/0158072 | A1 * | 7/2007 | Coleman et al. | 166/298 |
| 2010/0078218 | A1 | 4/2010 | Coleman, II et al. | |
| 2010/0108390 | A1 | 5/2010 | Teodorescu | |
| 2012/0043801 | A1 | 2/2012 | Wentworth et al. | |

OTHER PUBLICATIONS

International Preliminary Report on Patentability for International (PCT) Patent Application No. PCT/US11/47280, mailed Mar. 7, 2013, 7 pages.

"Foremost Reverse Circulation Drill Pipe," Foremost Industries, 2009, [retrieved on Nov. 17, 2010], 5 pages, Retrieved from: www.foremost.ca/index_rcpipe.php.

"Series 1000—Widecutter for Marble," Dazzini Macchine Srl, 2010 [retrieved on Oct. 6, 2010], 1 page.

"Solution Mining—Overview," Western Potash, no date, [retrieved on Sep. 27, 2010], 3 pages. Retrieved from: www.westernpostash.com/about-potash/solution-mining.

Xia et al., "Research on One Borehole Hydraulic Coal Mining System," Earth Science Frontiers, vol. 15, Issue 4, Jul. 2008, 4 pages.

Official Action for U.S. Appl. No. 13/212,594 mailed Jul. 1, 2013, 13 pages.

* cited by examiner

METHOD AND APPARATUS FOR CREATING A PLANAR CAVERN

CROSS-REFERENCE TO RELATED APPLICATIONS

This application claims the benefit of U.S. Provisional Patent Application Ser. No. 61/401,990, filed Aug. 23, 2010, the entire disclosure of which is hereby incorporated herein by reference.

FIELD

The present invention is directed to producing a planar cavern. More particularly, the disclosed invention provides methods and apparatuses for forming a planar cavern using directional drilling and rope sawing.

BACKGROUND

Various resource deposits can be mined from the Earth using man and machine entry techniques. With respect to resource deposits that are soluble, solution mining techniques can be used to remove the resource to the surface. In particular, solution mining involves dissolving a target evaporate in a solvent in situ to form a pregnant brine, and removing the pregnant brine to the surface. Evaporation, for example solar evaporation or evaporation aided by the addition of heat from a fossil fuel source, is then used to separate the target resource from the solvent.

Accordingly, solution mining requires transforming the target resource, such as halite (rock salt) or sylvite (potash), from a solid crystalline form to a brine. In particular, these salts are target minerals that will dissolve when wetted by the solvent to form the brine. The brine, replacing the volume of the target mineral in the crystalline state, is pumped from its below ground location to the surface and eventually to evaporation ponds or facilities. The rate of change from crystalline form to a dissolved form is a function of solvent temperature, purity (lack of solutes), agitation, and fluid pressure. As the goal is to produce a saturated brine (also known as a pregnant brine), purity cannot be positively affected, except that a solvent that is uncontaminated by other solutes can be applied. Agitation and control of solute temperature are variables that may be controlled to enhance productivity. Productivity of a bore may be defined as the total rate of change, measured in tons per day, of transformation of the target mineral from a crystalline state to a brine.

In one approach, the resource deposit is accessed using a vertical access shaft. Because many resource deposits that are the target of solution mining are in the form of planar deposits, a vertical well typically provides a very limited area over which the bore comprising the vertical well is in contact with the mineral resource. This limited surface area means that the area of the resource deposit exposed to the solvent is severely limited. This in turn limits the amount of the resource that can be placed in solution per unit time.

In order to increase the surface area of the resource deposit that can be contacted with solvent, horizontal bores can be formed using directional drilling techniques. In particular, bores can be formed that run through the resource deposit according to such techniques. Moreover, multiple horizontal bores in various patterns, such as an X, a fan, or rectangular grid, can be used. However, because the initial area of exposed resource deposit is limited to the area of the one or more bores within the resource deposit, the amount of the resource that can be placed in solution per unit time remains limited.

At least partially as a result of these limitations, major mining operations of resource deposits, such as potash, typically utilize man and machine entry techniques and occur only in areas with exceptionally large deposits. However, because such deposits often occur in areas of the world that are not amenable to the use of solar evaporation to recover the resource from the pregnant brine, heating, for example by burning natural gas, is required. Therefore, large amounts of energy must be expended in connection with such mining operations. Conversely, areas with large amounts of resource deposits that are in relatively thin, planar formations, occur in locales in which solar evaporation could be used efficiently. However, conventional mining of such deposits has typically been uneconomical.

SUMMARY

Embodiments of the present invention are directed to solving these and other problems and disadvantages of the prior art. In accordance with embodiments of the present invention, methods and systems for creating planar caverns are provided. In particular, a bore is formed from a first access point on the surface that extends down to a resource deposit. Once the resource deposit is reached, the bore continues horizontally through the resource deposit. As used herein, horizontal means within a plane traversing and/or substantially parallel to a mineral deposit. The bore is continued through the mineral deposit, and back to the surface at a second access point. Accordingly, a continuous bore is formed between the first and second access points. In accordance with embodiments of the present invention, the bore extends through the resource deposit for some distance, before looping back to the second access point to define a perimeter. A sawing assembly is then placed in the continuous bore, and is moved relative to the bore, to erode the resource and to thereby create a planar cavern.

In accordance with at least some embodiments of the present invention, a first blind bore, extending from a first access point, is formed. The first bore includes a first angled or tilted portion that extends from the first access point, through the overburden and to the resource deposit. The first bore then follows the resource deposit for a first distance, forming a first leg. The first leg is terminated in a curve. The curve initiates a second leg, also in the resource deposit. The second leg can be terminated in a dog leg curve. A second bore is formed starting at a second access point. The second bore includes a second angled or tilted portion that extends through the overburden to the resource deposit. The second bore then follows the resource deposit for a second distance, forming a first leg of the second bore. The second bore is then directed to intersect the dog leg portion of the first bore, to form a continuous bore. In accordance with embodiments of the present invention, the first leg of the second bore may be formed so that it is parallel or substantially parallel to the first leg of the first bore. Moreover, the first leg of the second bore can terminate in a curve that forms the beginning of a second leg of the second bore. The second leg of the second bore may be parallel or substantially parallel to the second leg of the first bore. By extending the second leg of the second bore until it intersects the dog leg portion of the first bore, the continuous bore is formed.

Once the first, second and/or continuous bores are formed, the drill strings used to form the bores can be withdrawn. A drill string can then be reinserted, through either the first access point or the second access point, to tow the sawing assembly through the continuous bore. In accordance with embodiments of the present invention, the sawing assembly includes a plurality of cutting bits disposed at intervals along a sawing assembly rope. A first end of the sawing assembly, extending from the first access point, can be interconnected to a first portion of an actuator or a winch assembly. A second end of the sawing assembly can be interconnected to a second portion of the winch assembly. The sawing assembly can then be moved relative to the continuous bore, such that the cutting bits act against a surface of the resource deposit exposed by the continuous bore. By applying and maintaining tension in the sawing assembly, the cutting bits may be drawn through the resource deposit, creating a planar cavern. After the sawing assembly has been drawn through the resource deposit, or the edge of the planar cavern has been advanced along all or nearly all the lengths of the first legs of the first and second bores, the sawing operation can be discontinued. During the sawing operation, or after the sawing operation has been completed, a solvent can be introduced into the cavern, to dissolve the exposed resource. Because the planar cavern exposes a large area of the resource deposit, a relatively large amount of the resource can be dissolved per unit time.

An apparatus in accordance with embodiments of the present invention includes a sawing assembly. The sawing assembly includes a sawing assembly tensile member or rope, and cutting bits attached at intervals to the sawing assembly tensile member or rope. Moreover, the cutting bits can be bidirectional, and can be disposed between first and second ends of the sawing assembly rope. A first end of the sawing assembly rope can be interconnected to a first portion of a winch assembly, while the second end of the sawing assembly rope can be interconnected to a second portion of the winch assembly. In accordance with further embodiments, a winch assembly can comprise first and second winches, that are interconnected to a common control system.

Additional features and advantages of embodiments of the disclosed invention will become more readily apparent from the following description, particularly when taken together with the accompanying drawings.

DETAILED DESCRIPTION

Figure 1:
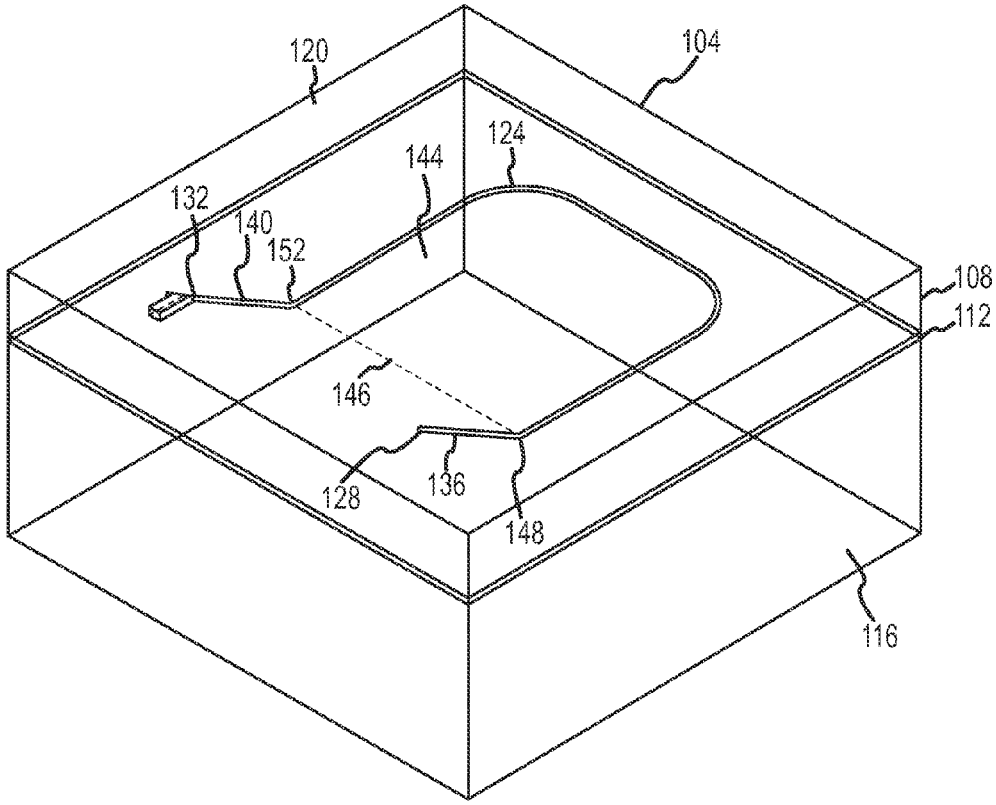
FIG. 1 is a perspective view of a mineral deposit accessed by a bore formed in accordance with embodiments of the present invention.

FIG. 1 is a perspective view of a section of earth 104 that includes an overburden section 108, a resource deposit 112 generally underlying the overburden 108, and a substrate portion 116, generally underlying the resource deposit 112. As depicted in the figure, the resource deposit 112 comprises a planar deposit. Although depicted in the figure as being constrained within a plane that is parallel to the surface 120 of the section 104, it should be appreciated that the resource deposit 112 can be within a plane that is tilted with respect to the surface 120, and/or that is tilted with respect to an absolute horizontal reference. In accordance with embodiments of the present invention, the resource deposit 112 may comprise a mineral deposit. Moreover, the resource deposit 112 may comprise minerals that can be dissolved by a solvent, and removed to the surface as a saturated solution or brine. Accordingly, examples of a mineral deposit 112 that can be effectively mined using embodiments of the present invention include but are not limited to potash and rock salt. In the figure, the section of earth 104 is shown as being transparent, to facilitate the clarity of the illustration.

In accordance with embodiments of the present invention, the resource deposit 112 is accessed by a continuous bore or borehole 124 that extends between a first access point or hole 128 and a second access point or hole 132. In general, the continuous bore 124 includes a first tilted shaft portion 136 that extends from the first access point 128 on the surface 120, through the overburden 108 and to the resource deposit 112. The continuous bore 124 then extends some distance from the first tilted shaft 136 through the resource deposit 112, and turns or loops back to a second tilted shaft 140 that extends from the resource deposit 112 to the second access point 132 on the surface 120. Accordingly, the continuous bore 124 generally defines an area 144 within the resource deposit 112, between the down hole end 148 the first tilted shaft 136 and the down hole end of 152 of the second tilted shaft 140, and a line (shown as a dashed line 146) between the down hole ends 148 and 152 of the tilted shafts 136 and 140. As will be described herein, embodiments of the present invention allow a planar cavern to be formed that extends through at least most of this area 144. Moreover, because both the floor and ceiling of this cavern can comprise the resource deposit 112, the surface area of the resource deposit 112 that is made available by the cavern to be contacted by a solvent is very large.

Figure 2:
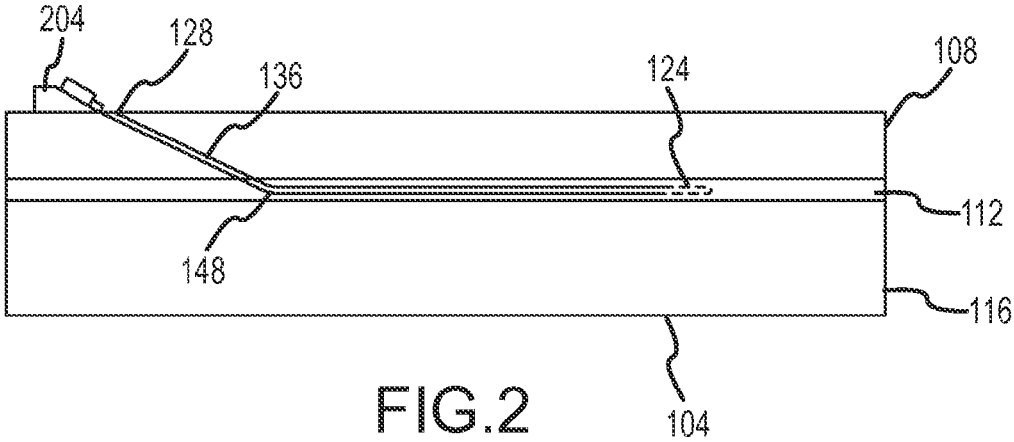
FIG. 2 is a cross-section in elevation of a mineral deposit accessed by a bore formed in accordance with embodiments of the present invention.
Figure 3:
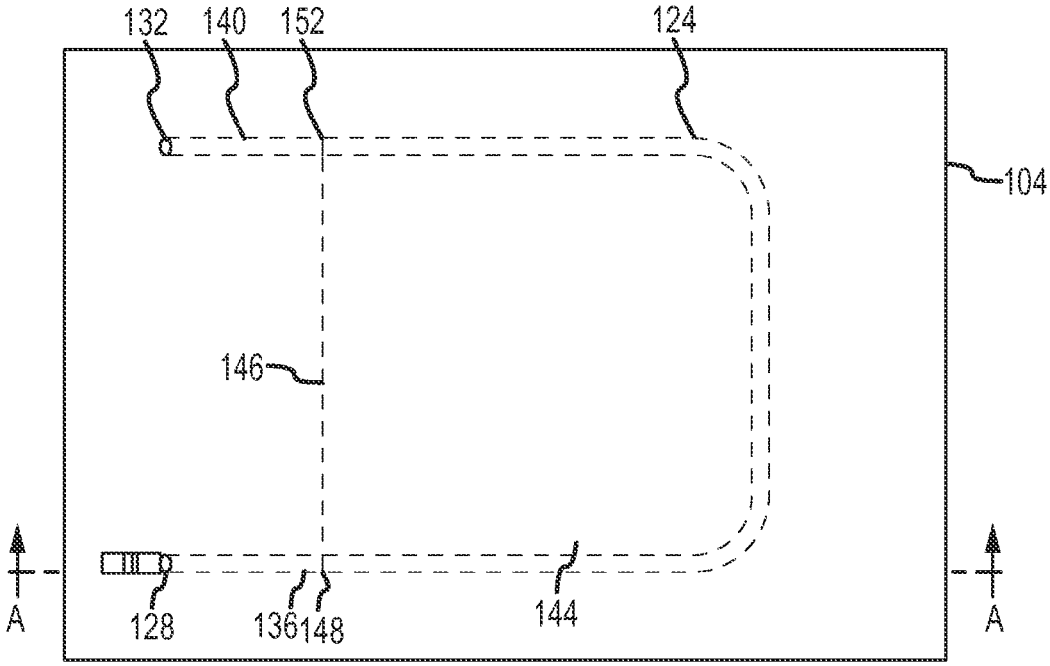
FIG. 3 is a plan view of a mineral deposit accessed by a bore formed in accordance with embodiments of the present invention.

FIG. 2 is taken along section line A-A of FIG. 3, and illustrates the continuous bore 124 in cross-section. In addition, a horizontal directional drilling rig 204 is depicted. As used herein, a horizontal directional drilling rig 204 includes a rig or assembly with a drill head that is capable of being steered such that a bore can be formed in a desired location, direction and depth. In general, the horizontal directional drilling rig 204 is used to form the continuous bore 124, starting with the first tilted shaft 136 at the first access point 128. The first tilted shaft 136 extends downwardly, through the overburden 108, until the resource deposit 112 is reached. At the down hole end 148 of the first tilted shaft 136, the horizontal directional drilling rig 204 is turned within a vertical plane, so that the continuous bore 124 extends through the resource deposit 112. In particular, the continuous bore 124 extends horizontally through the resource deposit. As used herein, horizontally means within a plane traversing or substantially parallel to a plane along which a target resource or resource deposit 112 is deposited. In particular, embodiments of the present invention include continuous bores 124 that, at least between the down hole ends 148 and 152 of the tilted shafts 136 and 140, are within or substantially within resource deposit 112, whether or not the resource deposit 112 lies in a plane that is tilted with respect to an absolute horizontal reference.

FIG. 3 is a plan view of the continuous bore 124 illustrated in FIGS. 1 and 2. As seen in FIG. 3, the continuous bore 124 can define three sides of a rectangular area 144, with a fourth side of the rectangular area 144 corresponding to a line 146 between the down hole end 148 of the first tilted shaft 136 and the down hole end 152 of the second tilted shaft 140. As will be described herein, the majority of the resource deposit 112 within the area 144 can be accessed by embodiments of the present invention by forming a planar cavern therein.

Figure 4:
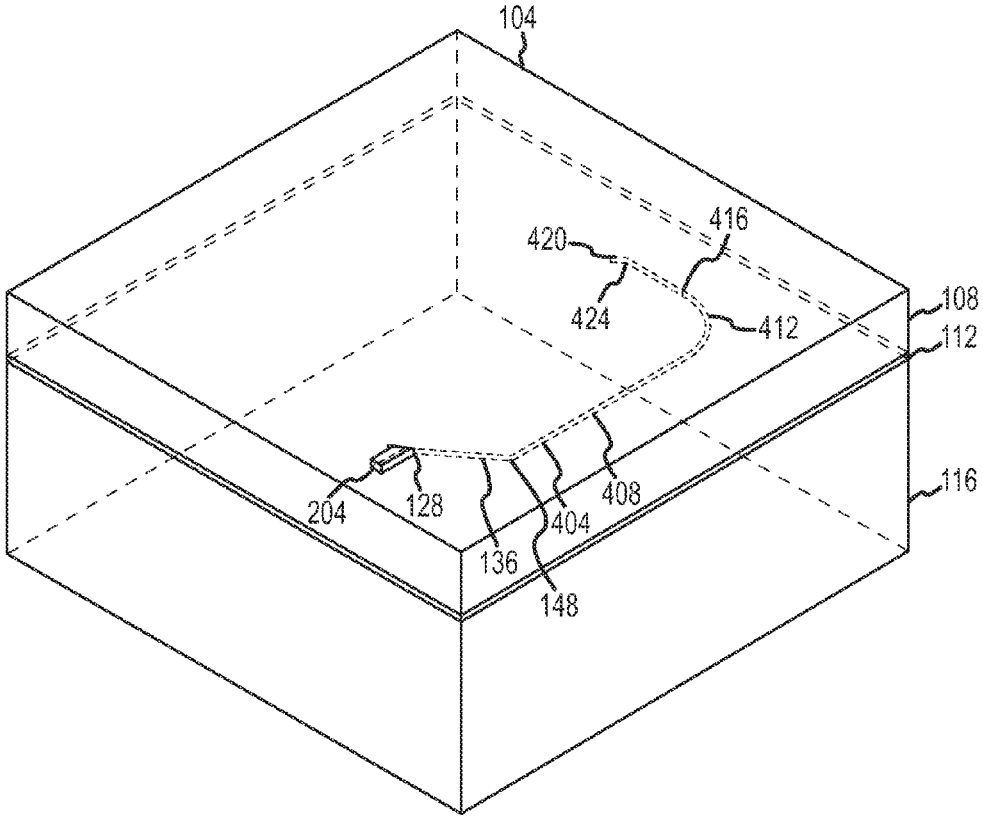
FIG. 4 is a perspective view of a first bore formed in accordance with embodiments of the present invention.

As can be appreciated by one of skill in the art after consideration of the present disclosure, forming a continuous bore 124 in a single directional drilling operation can, using commonly available drilling equipment, be impractical. Accordingly, formation of the continuous bore 124 may be accomplished by forming first and second bores using horizontal directional drilling techniques. In particular, as illustrated in FIG. 4, a blind first bore 404 can be formed. In general, the first bore 404 is formed using a horizontal directional drilling rig 204, and extends from the first access hole 128, down the first tilted shaft 136, and turns in elevation to form a first leg 408, which follows the resource deposit 112. An end of the first leg 408 can be defined at a first curve or arc 412, and continues for some distance along a second leg 416 to a blind terminus or end point 420. This second leg 416 can be within the resource deposit and at an angle of 90° with respect to the first leg 404. Moreover, in accordance with embodiments of the present invention, the first bore 404 is, from the down hole end 148 of the first tilted shaft 136 until the blind end 420, entirely within the resource deposit 112. In accordance with further embodiments of the present invention, the second leg 416 of the first bore 404 can include a slight curve or dog leg 424 prior to the blind end point 420. As can be appreciated by one of skill in the art after consideration of the present disclosure, the provision of a dog leg 424 at or towards the end point 420 of the first bore 404 can increase the area of the target presented by the first bore 404 to a second bore.

Figure 5:
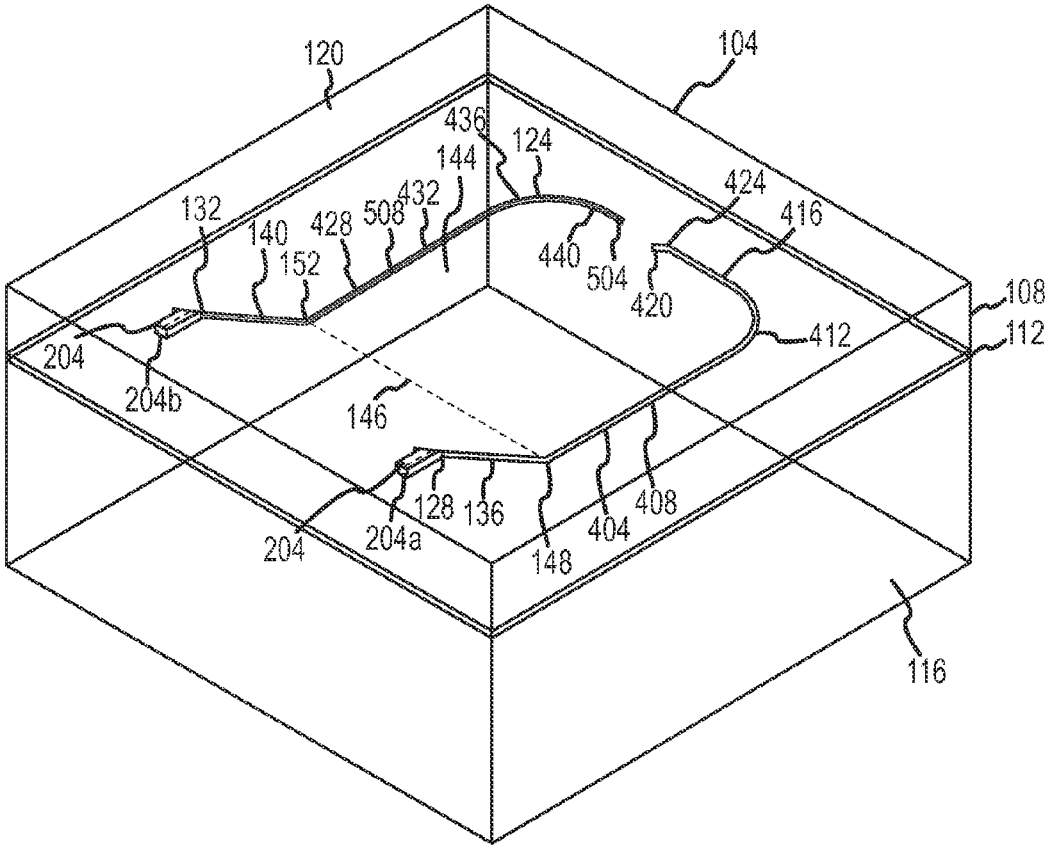
FIG. 5 is a perspective view of a first bore and a partially completed second bore in accordance with embodiments of the present invention.

With reference to FIG. 5, a second bore 428 is illustrated in a partially completed state. In the figure, the section of earth 104 is shown as being transparent, to facilitate the clarity of the illustration. In particular, the second bore 428 extends from the second access hole 132, down a second tilted shaft 140, and from the down hole end 152 of the second tilted shaft 140 to a first leg 432 of the second bore 428, through a curve 436 that turns the second bore 428 towards the end point 420 of the first bore 404, and that forms the beginning of a second leg 440 of the second bore 428. In the state illustrated in FIG. 5, the second bore 428 is in the process of being formed using a horizontal directional drilling rig 204 located at or adjacent the second access hole 132. In particular, the horizontal directional drilling rig 204 at the second access hole 132 is operated to direct a drill head or bit 504 at the end of a drill string 508 such that the second bore 428 is steered towards and intersects the terminal end 420 or dog leg portion 424 of the first bore 404. In accordance with embodiments of the present invention, intersecting the first bore 404 with the second bore 428 is facilitated by the provision of the dog leg portion 424 at or near the terminal end 420 of the first bore 404. By thus interconnecting the first bore 404 with the second bore 428, a continuous bore 124 (see FIG. 1) is formed. In accordance with embodiments of the present invention, the second bore 428 is, from the down hole end 152 of the second tilted shaft 140 to the point at which it intersects the first bore 404, entirely within the resource deposit 112.

After the first bore 404 has been completed up to the terminal end 420, the drill head used to form the first bore 404 can be pulled back to the end of the second leg 416 of the first bore 404, such that the drill head and drill string do not occupy the first bore 404 from the dog leg portion 424 to the end point 420. However, the drill stem can be left in the remainder of the first bore 404. As can be appreciated by one of skill in the art after consideration of the present disclosure, withdrawing the drill head and drill stem from the end portion of the first bore 404 leaves that portion clear to prevent possible damage to the drill head and connected drill string when the second bore 428 is connected to the first bore 404. The drilling rig 204 can then be disconnected from the drill string at the first access hole 128, and moved to the second access hole 132 (or the area in which the second access hole 132 is to be formed) to drill the second bore 428. Alternatively, a first horizontal directional drilling rig **204*a* can be used to form the first bore 404 while a second horizontal directional drilling rig 204*b* can be used to form the second bore 428**.

Figure 6:
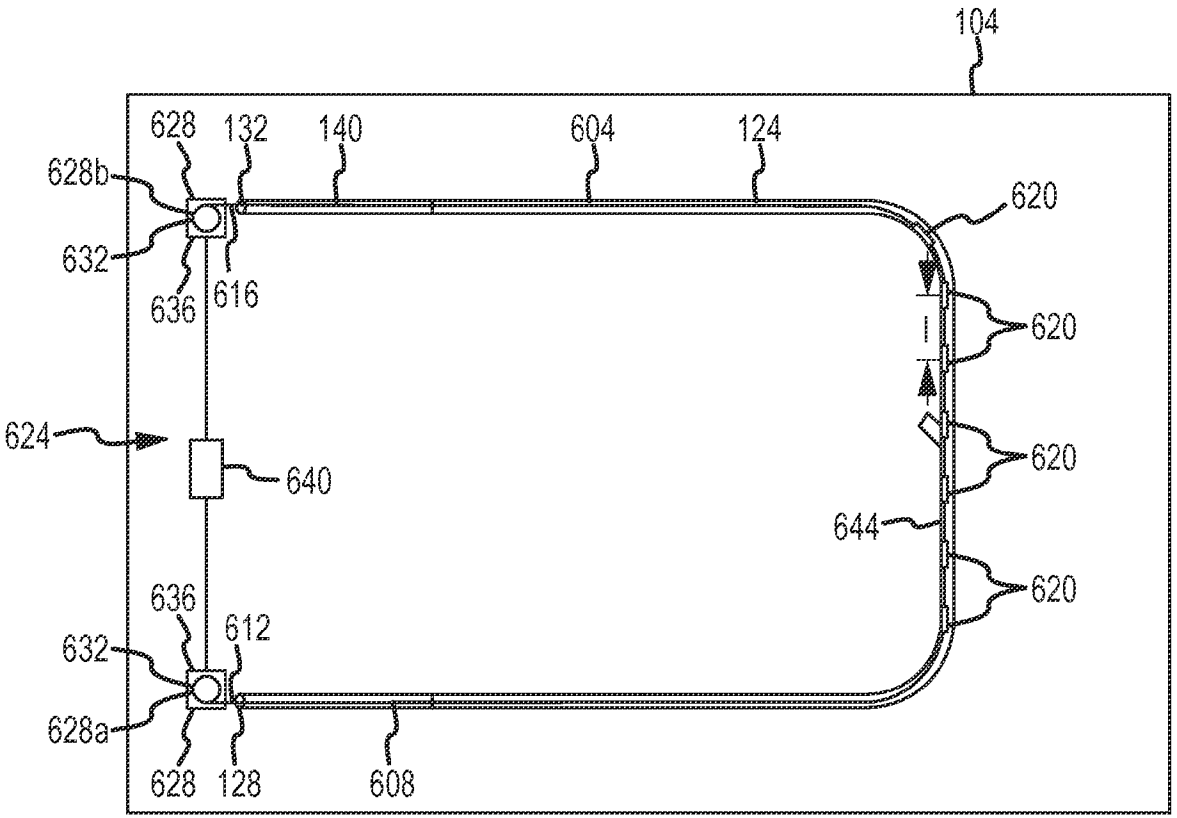
FIG. 6 is a plan view of a continuous bore with a sawing assembly inserted therein in accordance with embodiments of the present invention.

FIG. 6 is a plan view of a continuous bore 124, with a sawing assembly 604 in accordance with embodiments of the present invention inserted therein. In the figure, the overburden is shown as if it was transparent, to facilitate illustration of the sawing assembly 604 in the continuous bore. In general, the sawing assembly 604 includes a rope member 608 with a first end 612 that extends from the first access hole 128 and a second end 616 that extends from the second access hole 132. The sawing assembly 604 also includes a plurality of cutting bits 620 that are fixed to the rope member 608 at intervals I along the rope member 608. Insertion of the sawing assembly 604 in the continuous bore 124 can be accomplished by towing the assembly from the first access point 128 to the second access point 132, or alternatively from the second access point 132 to the first access point 128, using a drill string.

The first 612 and second 616 ends of the sawing assembly 604 are interconnected to an actuator or a winch assembly 624. In general, the winch assembly 624 can operate to cycle or reciprocate the sawing assembly 604 over a distance that is equal to or greater than the interval I separating the centers of adjacent cutting bits 620. The cutting bits 620, which act on a receding edge 644 of the resource deposit 112 through tension and motion applied to the sawing assembly 604 by the winch assembly 624, erode that receding edge 644 of the resource deposit 112. The winch assembly 624 can include a first winch unit **628*a* to which the first end 612 of the sawing assembly 604 is interconnected, and a second winch unit 628*b* to which the second end 616 of the sawing assembly rope 608 is interconnected. Each winch unit 628 generally includes a rope handling unit or drum 632 and a drive motor or engine 636. Alternatively, one engine 636 can be used, since only one end 612 or 616 of the sawing assembly 604 is pulled at a time. The winch assembly 624 can additionally include a controller 640, to coordinate operation of the winch units 628**.

Figure 7:
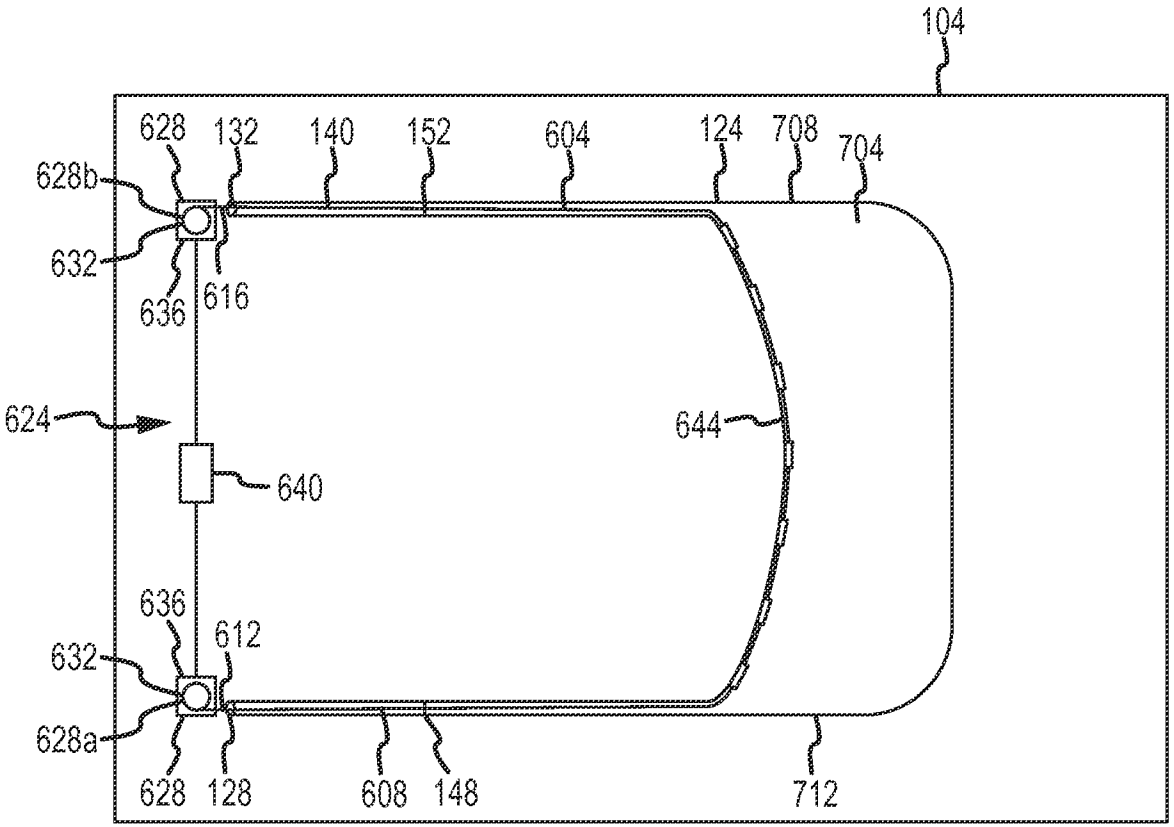
FIG. 7 is a plan view of a partially completed planar cavern in accordance with embodiments of the present invention.

FIG. 7 is a plan view of a partially completed planar cavern 704 created by the reciprocation or movement of the sawing assembly 604 in the continuous bore 124. The overburden is again shown as if it was transparent, to facilitate illustration of the sawing assembly 604 in the continuous bore 124, and the planar cavern 704 being formed. In particular, the receding edge 644 has advanced towards the down hole ends 148 and 152 of the first and second tilted shafts 136 and 140, extending the area of the planar cavern 704. Moreover, first 708 and second 712 side surfaces of the planar cavern 704 can be seen to correspond to the first legs 408 and 432 of the first 404 and second 428 bores. In order to facilitate the removal of shavings produced by the cutting action of the sawing assembly 604, solvent can be added to the well or continuous bore 124. Because the shavings produced by the cutting action of the sawing assembly 604 are relatively high in surface area and low in cross section, they will dissolve relatively quickly in the solvent. Dissolution of the shavings can also be promoted by the agitation provided by the movement of the sawing assembly 604 in the continuous bore 124.

Figure 8:
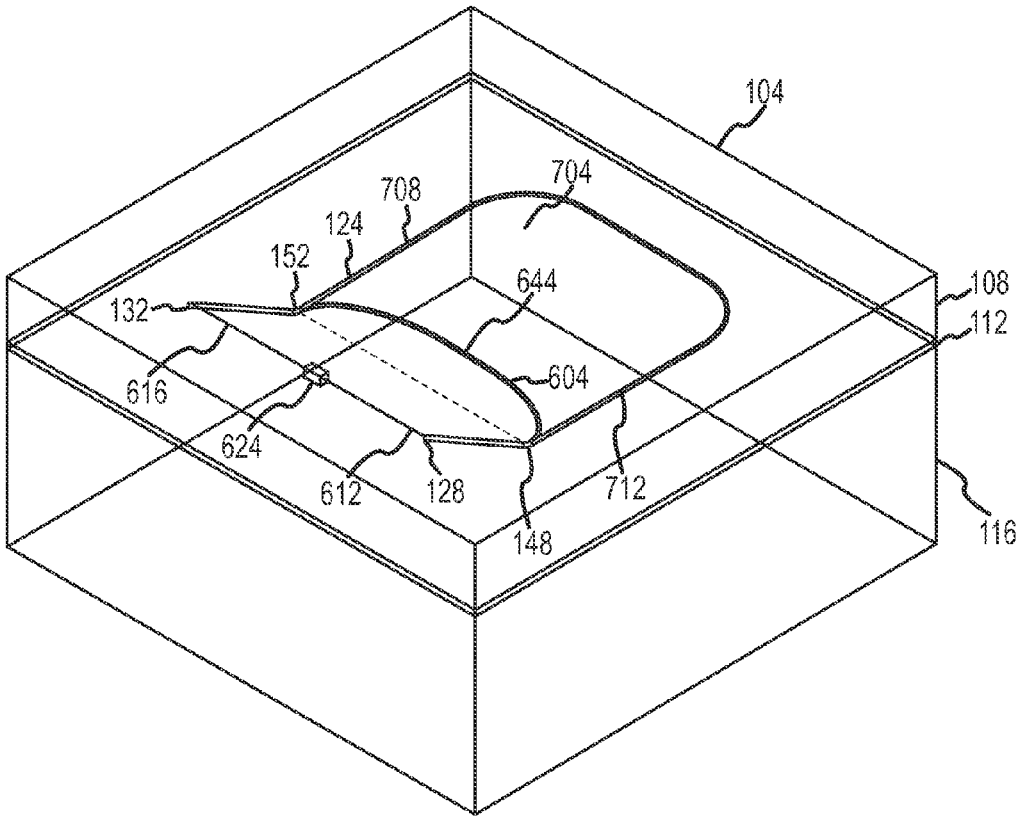
FIG. 8 is a perspective view of a planar cavern and a sawing assembly after a sawing operation in accordance with embodiments of the present invention is complete.

FIG. 8 is a perspective view of a planar cavern and the sawing assembly after a sawing operation to form a planar bore in accordance with embodiments of the present invention is complete. In the figure, the section of earth 104 is shown as being transparent, to facilitate the clarity of the illustration. As shown in the figure, the down hole portions of the sawing assembly 604 have advanced, moving the eroded edge 644 of the planar cavern 704 towards the down hole ends 148 and 152 of the tilted shafts 136 and 140. FIG. 8 also shows that the eroded edge 644 of the planar cavern 704 has acquired a curved shape. For example, the eroded edge 644 may have a parabolic shape after sawing using the sawing assembly 604. In addition, once the eroded edge 644 of the planar cavern 704 has advanced along all or substantially all of the first leg portions 408 and 428 of the continuous bore 124, the sawing operation is halted. The sawing assembly 604 can then be withdrawn from the continuous bore 124 and the planar cavern 704. The planar cavern 704 remaining after completion of the sawing operation presents a very large surface area. Moreover, where the planar cavern 704 is formed such that all surfaces of the planar cavern are within the resource deposit 112, the area of resource deposit that can be exposed to a solvent is very large, especially as compared to the surface area of a resource deposit that is exposed using conventional vertical or horizontal drilling techniques.

Figure 9:
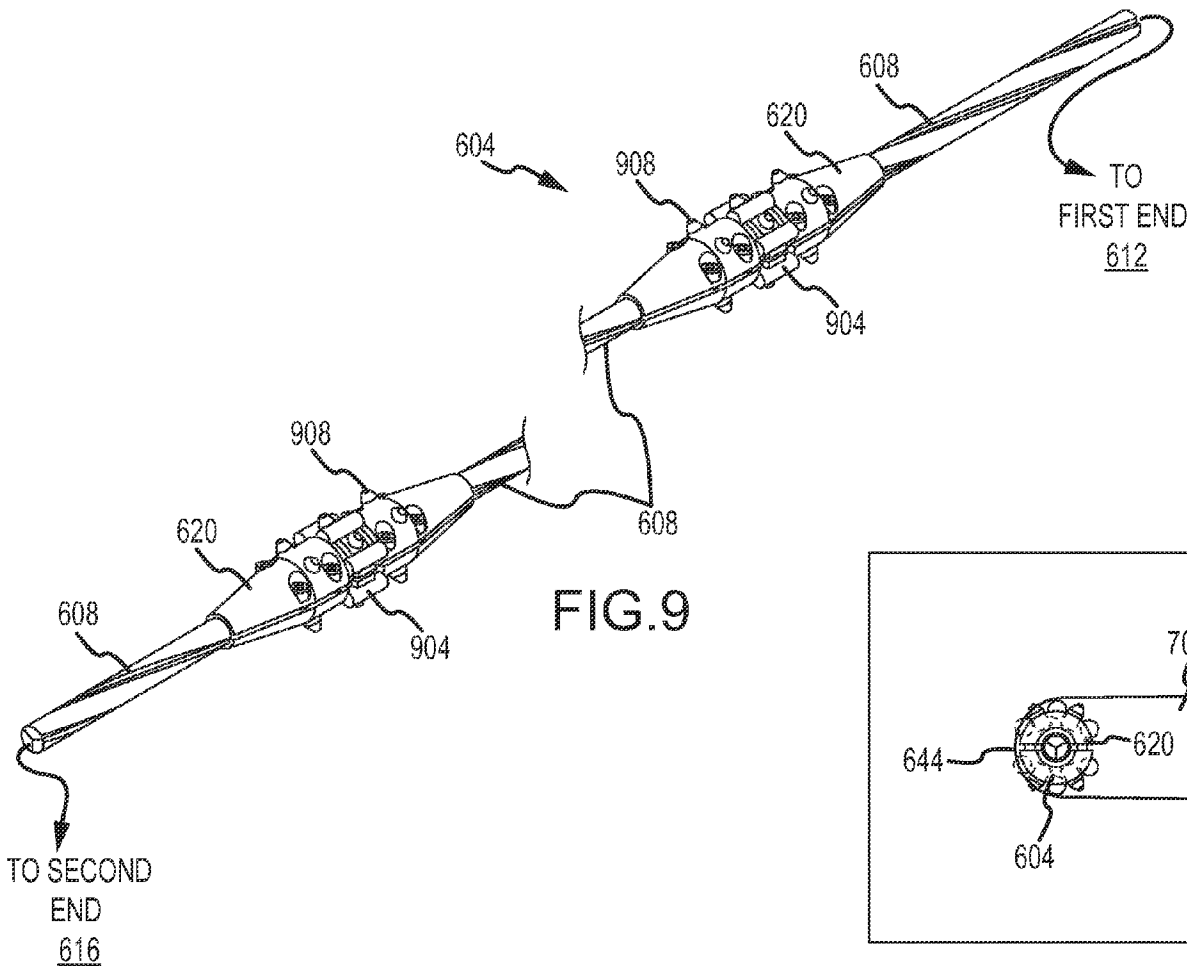
FIG. 9 is a perspective view of a portion of a sawing assembly in accordance with embodiments of the present invention.

FIG. 9 is a perspective view of a portion of a sawing assembly 604 in accordance with embodiments of the present invention. As illustrated in the figure, the sawing assembly includes a rope 608 and a plurality of cutting bits 620. The cutting bits 620 are fixed to the rope 608 at intervals. The cutting bits 620 can include a plurality of bidirectional cutters 904 and/or studs 908 that bear against the resource deposit and shear material therefrom as the cutting assembly 604 is towed across the eroded edge 644 of the resource deposit 112. In accordance with embodiments of the present invention, the rope 608 may comprise a 3×19 swaged style rope. In accordance with other embodiments, the rope 608 may comprise flexible rod. In accordance with still other embodiments, the rope 608 may comprise one or more components that are flexible enough to travel along the length of the continuous bore 124, and that are strong enough to transfer tensile force from the winch assembly 624 to the cutting bits 620.

Figure 10:
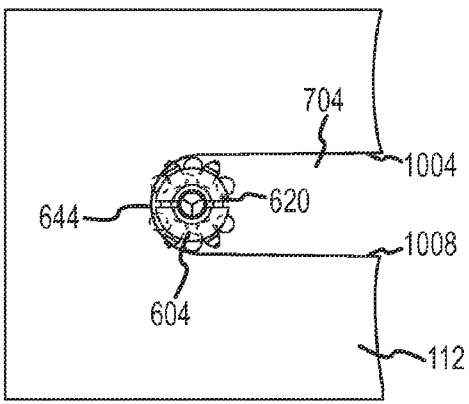
FIG. 10 is a cross-section of a sawing assembly used to form a planar cavern in accordance with embodiments of the present invention, in a section of a mineral deposit.

FIG. 10 is a cross-section of a sawing assembly 604 eroding a resource deposit 112 along the receding edge 644 of a planar cavern 704 in accordance with embodiments of the present invention. As illustrated in the figure, the planar cavern 704 thus formed includes a ceiling 1004 and a floor 1008.

Figure 11:
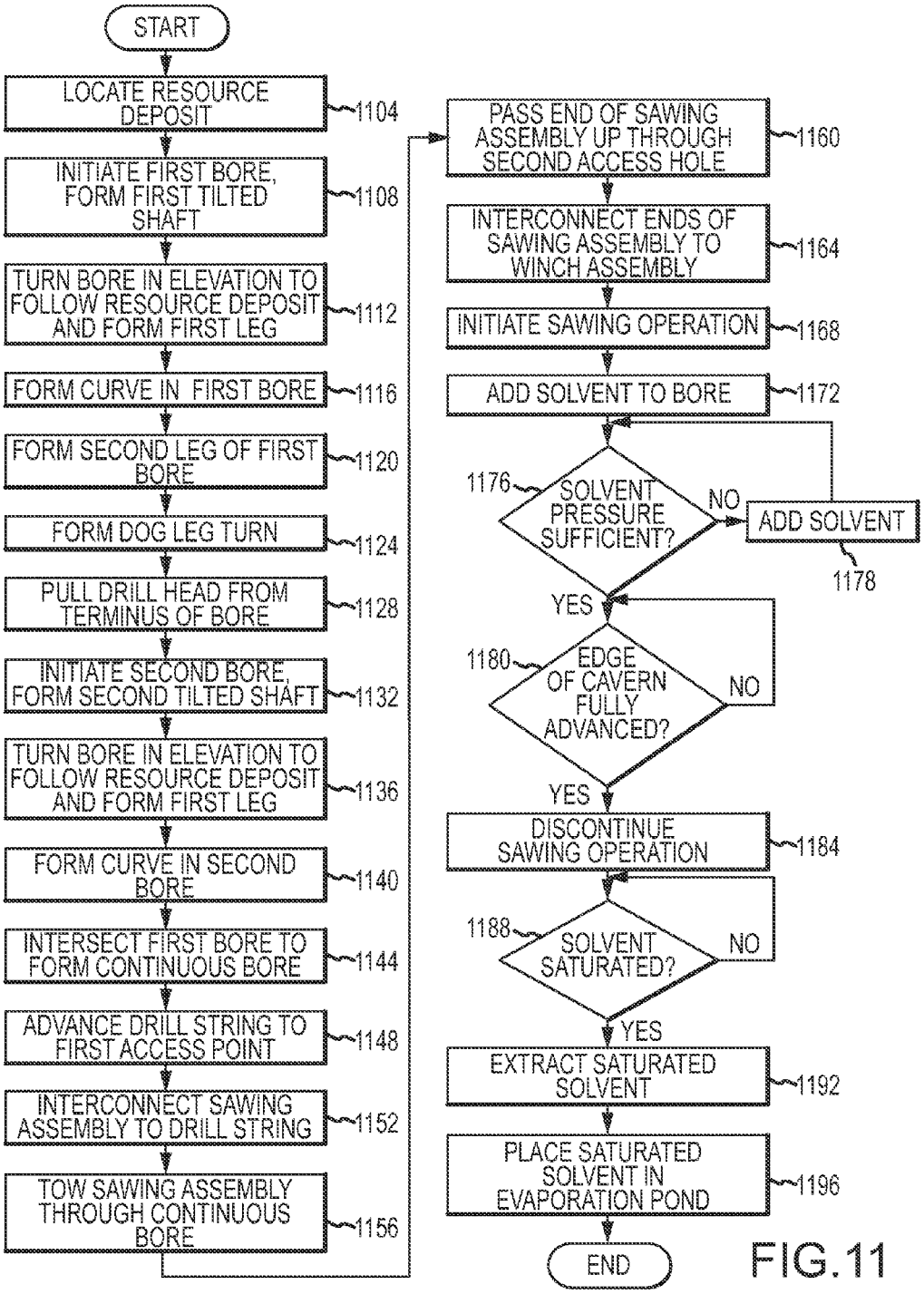
FIG. 11 is a flowchart depicting aspects of a process for forming a planar cavern in accordance with embodiments of the present invention.

FIG. 11 is a flowchart depicting aspects of a process for forming a planar cavern in accordance with embodiments of the present invention. Initially, at step 1104, a planar or stratified resource deposit 112 is located. The resource deposit 112 is then accessed by a first, non-planar bore 404, initiated from the first access point 128 (step 1108). The first bore 404 can be formed using horizontal directional drilling techniques. Moreover, the first bore 404 can extend from the first access point 128, through the overburden at, for example, a 30° angle forming a first tilted shaft 136 until the resource deposit 112 is reached. At step 1112, the horizontal direction drill is controlled so that a first leg 408 of the bore follows the plane of the resource deposit 112. For example, if the resource deposit 112 occupies a horizontal plane, the first bore 404 will level out and follow a horizontal path. As can be appreciated by one of skill in the art after consideration of the present disclosure, the first leg 408 of the first bore 404 need not follow a horizontal path, for example where the resource deposit 112 is tilted. In such instances, the first bore 404 will, in the first leg 408, follow a path that maintains the first bore 404 within the resource deposit 112. After extending along the first leg 408 for a desired distance, a bend or curve is formed (step 1116). For example, the curve can be contained until a 90° change of direction has been achieved and a second leg 416 of the first bore 404 has been formed. The second leg 416 extends for some distance, for example for about half the distance of the first leg (step 1120). At step 1124, the direction of the second leg 416 is changed, so that the first bore 404 presents additional area in a plane that is generally transverse to the direction of the second leg 416 of the first bore 404. For example, a dog leg turn can be formed immediately prior to the end point 420 of the first bore 404. At step 1128, the drill head is pulled back from at least the dog leg portion 424 of the first bore 404, while leaving the drill string in the remainder of the first bore 404 to prevent a bore cave in.

At step 1132, a second bore 428 is initiated from the second access point 132. The second bore 428 can be started parallel to and offset from the first leg 408 of the first bore 404. More particularly, the second bore 428 may comprise a near mirror image of the first bore 404. Accordingly, the second bore 428 may gain depth by traveling at an angle of 30° to the horizontal forming a second tilted shaft 140 until the resource deposit 112 is reached. A first leg 432 of the second bore 428 can then be formed by leveling out or otherwise turning in elevation to follow the plane of the resource deposit 112 along a line that is generally parallel to the first leg 408 of the first bore 404 (step 1136). The first leg 432 of the second bore 428 is continued for a distance equal or about equal to the length of the first leg 408 of the first bore 404, at which point a turn towards the terminal end 420 of the first bore 404 is initiated (step 1140). The second bore 428 is then continued along a second leg 440, until the dog leg portion 424 of the first bore 404 is intersected by the second bore 428 (step 1144). By intersecting the first bore 404 with the second bore 428, a continuous bore 124, extending between the first 128 and second 132 access points is formed. Moreover, in accordance with embodiments of the present invention, the continuous bore 124 is, at least between the down hole ends 148 and 152 of the tilted shafts 136 and 140, entirely within the resource deposit 112.

At step 1148, the drill string used to form the second bore 428 is further inserted and advanced along the first bore 404 towards the first access point 128. If the drill string used to form the first bore 404 has been left in that bore 404, it is removed ahead of the advancing drill string being inserted from the second access point 132. The advancement of the drill string from the second access point 132 is halted once that drill string emerges from the first access point 128. At step 1152, an end (e.g., the second end 616) of a rope sawing assembly 604 can be interconnected to the drill string at the first access point 128. The drill string is then withdrawn from the second access point 132, towing the sawing assembly 604 through the continuous bore 124 (step 1156). At step 1160, the drill string is removed from the second access hole 132, and the end of the sawing assembly 604 is passed up through the access hole 132.

At step 1164, the first and second ends 112 and 116 of the sawing assembly 604 are interconnected to a winch assembly 624. A sawing operation is then initiated (step 1168). In accordance with embodiments of the present invention, the sawing operation includes first pulling on a first end of the sawing assembly 604 while paying out a second end of the sawing assembly 604. After the sawing assembly 604 has traveled some distance, the operation is reversed, and the second end of the sawing assembly 604 is pulled while the first end of the sawing assembly 604 is payed out. In general, the distance traveled prior to reversal should be greater than the spacing or interval between cutting bits 620. However, to maintain level cutting forces, the majority of the cutting bits 620 should be engaged against the receiving edge 644 of the planar cavern 704, rather than against the sides of the first legs 408 and 428 of the first 404 and second 428 bores. In addition, for a given end of the sawing assembly 604, each pull will haul in more rope 608 than is subsequently payed out at that end, due to the shortening of the distance between the first 128 and second 132 access points traversed by the sawing assembly 604 as the eroded edge 644 of the planar cavern 704 advances towards the access points 128 and 132. In accordance with alternative embodiments, the sawing assembly can be pulled through the continuous bore hole 124 in one direction, in a continuous manner.

As the sawing operation continues, a solvent can be added to the continuous bore 124 (step 1172). For example, solvent can be added through one or both of the first 128 and second 132 access holes. By adding solvent while the sawing operation is being performed, shavings produced by the cutting action and the advancement of the receding edge 644 of the planar cavern 704 can be removed. In addition, the presence of the solvent in the planar cavern 704 can be maintained at a level that is equal to or greater than the overburden pressure. In accordance with embodiments of the present invention, the addition of solvent to the continuous bore 124 can be facilitated by the provision of wash over casings placed in the first 136 and/or second 140 tilted shafts.

Figure 12:
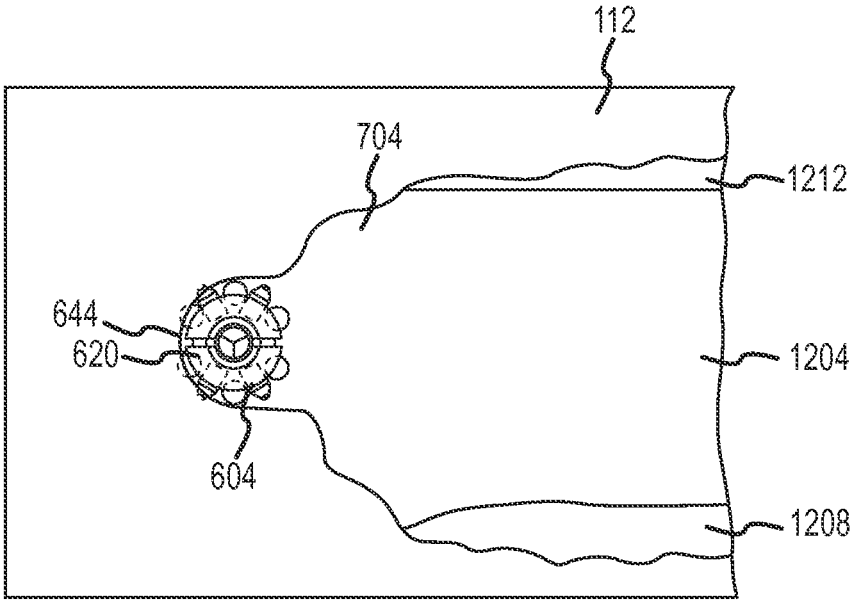
FIG. 12 is a cross-section of a planar cavern containing a solvent solution in accordance with embodiments of the present invention.

At step 1176, a determination can be made as to whether the pressure of the solvent in the planar cavern 704 is equal to or greater than the overburden pressure. If the pressure of the solvent in the planar cavern 704 is not equal to or greater than the overburden pressure, additional solvent can be added through an access hole 128 or 132 (step 1178). Maintaining solvent pressure at a level equal to or greater than the overburden pressure is desirable, in order to help prevent structural collapse of the planar cavern 704. In addition, dissolution of the floor and/or ceiling of the planar cavern 704 can be controlled. In particular, the floor of the cavern will cease to dissolve once the solvent becomes saturated with the target resource. In non-turbulent conditions, the saturated brine sinks to the bottom of the planar cavern 704, coating the floor and discouraging further dissolution. Ceiling dissolution can be ceased or inhibited by injecting a non-solvent liquid having a lower specific gravity than the solvent, such that the non-solvent liquid rests against the ceiling of the planar cavern 704. Where the solvent is water or a water based liquid, examples of non-solvent liquids that can be injected to control ceiling dissolution include diesel fuel and other light hydrocarbons. Accordingly, in non-turbulent conditions and prior to complete saturation of the solvent, the saturated brine sinks to the bottom of the planar cavern 704, coating the floor and discouraging further dissolution, while the non-solvent liquid occupies a top layer of solution in the planar cavern 704, and unsaturated solution occupies a middle layer, between the non-solvent liquid and the saturated or pregnant solution. This is illustrated in FIG. 12, which shows a cross-section of the planar cavern 704, with unsaturated solvent 1204 generally held in a layer between saturated solvent 1208 lying along the partially dissolved floor 1008, and a light, non-solvent liquid 1212, forming a barrier against the partially dissolved ceiling 1004.

With reference again to FIG. 11, at step 1180, a determination may be made as to whether the eroded edge 644 of the planar cavern 704 has advanced to a maximum extent. In general, the eroded edge 644 will attain a curved shape. Moreover, it generally is not practical to continue sawing until the eroded edge 644 is straight or substantially straight. In particular, attempting to straighten the eroded edge 644, can result in kinking of the sawing assembly 604. Accordingly, once the sides of the planar cavern 704 have advanced down the parallel sides of the continuous bore 124 to the down hole ends 148 and 152 of the tilted shafts 136 and 140, the sawing operation should generally be discontinued to avoid damage to the sawing assembly 604 (step 1184). Once the eroded edge 644 has been advanced to a maximum point, the sawing assembly 604 can be removed through either the first 128 or the second 132 access hole.

At step 1188, a determination can be made as to whether the solution is sufficiently saturated. This determination can be made by allowing a selected period of time to elapse after introduction of the solvent to the planar cavern 704. As can be appreciated by one of skill in the art, the time required for a solvent to be saturated will depend on various factors, including temperature, pressure, agitation, material purity, and volume of solvent versus wetted surface area of the resource. Alternatively or in addition, the level of saturation of the solvent can be determined through sampling. Once a desired saturated level has been achieved, extraction of the pregnant brine can begin (step 1192). This can be performed by pumping the pregnant brine to the surface and placing it in solar reclamation or evaporation ponds (step 1196). The process may then end.

In accordance with an exemplary embodiment of the present invention, the area 144 within which the planar cavern 704 is formed can be rectangular. For example, and without limitation, the first legs 408 and 432 of the first 408 and second 428 bores can be parallel to one another, and can extend for about 2,000 feet (610 meters). Moreover, the corners at the ends of the first legs 408 and 432 can describe a curve having a common radius. The second legs 416 and 440 of the first and second bores can have a length of about 1,000 feet (305 meters). Accordingly, the area 144 in which the planar cavern 704 is formed can have a length of about 2,000 feet (610 meters) and a width of about 2,000 feet (610 meters). As an example, the diameter of the continuous bore 124 formed by the horizontal directional drilling operation can be about 6 inches (15 centimeters). Where the ceiling 1004 and the floor 1008 of the planar cavern 704 comprise the target material 112, the exposed area is about 8 million square feet (744,200 square meters). Moreover, for an overburden 108 having a depth of about 480 feet (146 meters), if the tilted shafts 136 and 140 are at an angle of about 30°, the length of the continuous bore 124 that must be drilled is about 8,060 feet (2,457 meters).

As previously described, embodiments of the present invention can move the sawing assembly 604 in a reciprocating fashion. Where, for example, a distance between cutting bits 620 is 100 feet (30 meters), the amount of rope 608 that is withdrawn during a reciprocation cycle may be 120 feet (36 meters). In an exemplary embodiment, the cutting bits 620 may have a diameter of about 6 inches (15 centimeters) and a length of about 2 feet (61 centimeters). Where the sawing assembly 604 is moved in a continuous fashion, provision must be made to address contact between the cutting bits 620 and various components or structures that come into contact with the cutting bits 620 as a result of the continuous motion, such as wash over casings, sheaves, and winch drums. In accordance with still other embodiments, whether the sawing assembly 604 is moved in a reciprocating or a continuous fashion, cutting bits or members can comprise a coating applied to the rope. For example, a sawing assembly 604 can comprise a diamond rope saw.

Although exemplary embodiments of the present invention have been illustrated and described that include a continuous bore 124 that, at least within the resource deposit 112, describes three sides of a rectangle, other shapes are possible. For example, the continuous bore 124 can form a loop of any shape. In particular, the continuous bore 124 will include an angle or a curve in a portion of the continuous bore 124 that is within the resource deposit 112. In addition, although exemplary embodiments of the present invention have been illustrated that feature a continuous bore 124 that extends between first 128 and second 132 access points, other configurations can be provided in accordance with embodiments of the present invention. For example, a single access hole 128 on the surface 120 of an overburden can be associated with a shaft 136 that accesses a resource deposit 112. The continuous loop 124 can then be formed that extends from and returns to the tilted shaft 136. In accordance with still other embodiments, the resource deposit 112 can be accessed with a large shaft, at the bottom of which a horizontal directional drilling rig 204 is placed, and a continuous bore formed through first and second access points formed in the resource deposit. In accordance with still other embodiments, the continuous bore 124 can be formed from a location intermediate the surface 120 and the mineral deposit 120.

Although examples provided herein have discussed the use of water or water-based solutions as solvents, and has given as examples sylvite and halite as target resources, other solvents and target resources can be used to recover resources using a planar cavern formed using methods and/or systems in accordance with embodiments of the present invention. In particular, any subsurface deposit that can be dissolved in a liquid can be recovered using embodiments of the present invention. Moreover, embodiments of the present invention can be usefully employed wherever a subsurface cavern having a large surface area is desired.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with various modifications required by the particular application or use of the invention. It is intended that the appended claims be construed to include alternative embodiments to the extent permitted by the prior art.

What is claimed is:

1. A method for forming a planar cavern, comprising:

drilling a first bore, wherein the first bore extends from a first access point to a resource deposit, and wherein the first bore extends through at least a portion of the resource deposit;

drilling a second bore, wherein the second bore extends from a second access point to the resource deposit, wherein the second bore intercepts the first bore to form a continuous bore with a first end at the first access point and a second end at the second access point, and wherein at least one of the first bore and the second bore includes a first curve;

towing a sawing assembly through the continuous bore, wherein a first end of the sawing assembly extends from the first access point, and wherein a second end of the sawing assembly extends from the second access point;

placing a solvent in contact with the resource deposit through the continuous bore;

moving the sawing assembly relative to the continuous bore, wherein moving the sawing assembly relative to the continuous bore forms a planar cavern, and wherein moving the sawing assembly is performed at least partially while the solvent is in contact with the resource deposit.

2. The method of claim 1, wherein at least some of the resource included in the resource deposit dissolves in the solvent to form a pregnant brine.

3. The method of claim 2, further comprising:

removing the pregnant brine from the continuous bore.

4. The method of claim 2, further comprising:

placing a non-solvent in the continuous bore, wherein the non-solvent has a density that is less than a density of the solvent.

5. The method of claim 1, wherein the solvent is placed in the continuous bore and is held at a pressure that is greater than or equal to an overburden pressure.

6. The method of claim 1, wherein the first bore and the second bore are substantially parallel to one another proximate to a point at which the first and second bores intersect.

7. The method of claim 1, wherein forming the first bore includes forming a dog leg at a terminus of the first bore, and wherein the second bore intercepts the first bore at the dog leg.

8. The method of claim 1, wherein drilling a first bore includes:

using a horizontal directional drill, drilling downwardly from the first access point through an overburden to the resource deposit, wherein a first tilted shaft is formed;

turning the horizontal directional drill in elevation so that the first bore follows the resource deposit, wherein a first leg of the first bore is formed;

turning the horizontal direction drill in the resource deposit to form a first curve of the first bore, wherein the first leg of the first bore terminates at the first curve, and wherein a second leg of the first bore is initiated at the first curve of the first bore; and wherein drilling a second bore includes:

using a horizontal directional drill, drilling downwardly from the second access point through the overburden to the resource deposit, wherein a second tilted shaft is formed;

turning the horizontal directional drill in elevation so that the second bore follows the resource deposit, wherein a first leg of the second bore is formed;

turning the horizontal directional drill in the resource deposit to form a first curve of the second bore, wherein the first leg of the second bore terminates at the first curve, and wherein a second leg of the second bore is initiated at the first curve of the second bore;

continuing the second leg of the second bore until the second leg of the second bore intersects the second leg of the first bore.

9. The method of claim 8, wherein the second leg of the first bore is parallel to the second leg of the second bore.

10. The method of claim 8, further comprising:

forming a dog leg curve at a terminal end of the second leg of the first bore, wherein the second bore intersects the first bore at the dog leg curve.

11. The method of claim 10, further comprising:

placing an open end casing in the first bore between the first access point and the first leg of the first bore; and placing an open end casing in the second bore between the second access point and the first leg of the second bore.

12. The method of claim 1, wherein towing a sawing assembly through the continuous bore includes towing the sawing assembly through the continuous bore with a drill stem, wherein cutting bits included in the sawing assembly are placed in contact with the resource deposit, wherein moving the sawing assembly includes reciprocating the sawing assembly, and wherein in each of a plurality of reciprocations the sawing assembly is moved a distance that is greater than a spacing between cutting bits.

13. A method for forming a planar cavern, comprising:

forming a continuous bore, wherein the continuous bore extends for some distance through a subsurface resource deposit, wherein the continuous bore includes at least one curve in a portion of the continuous bore that is within the subsurface resource deposit, and wherein the continuous bore is in communication with at least a first access point on a surface of an overburden;

placing a sawing assembly in the continuous bore;

moving the sawing assembly along the continuous bore, wherein a cutting force is applied to at least a portion of the borehole extending into the subsurface resource deposit, and wherein a planar subsurface cavern is formed; and placing a solvent in the continuous bore, wherein moving the sawing assembly is performed at least partially while the solvent is in contact with the subsurface resource deposit.

14. The method of claim 13, further comprising:

removing solvent containing a dissolved resource to the surface.

15. The method of claim 13, wherein the continuous bore includes at least three legs within the subsurface resource deposit.

16. The method of claim 15, wherein the continuous bore is formed using multiple boring operations.

17. The method of claim 13, further comprising:

maintaining the solvent in the continuous bore at a pressure equal to an overburden pressure.

18. The method of claim 13, further comprising:

placing a non-solvent in the continuous bore, wherein the non-solvent has a density that is less than a density of the solvent.

* * * * *